United States Patent [19]

Morris et al.

[11] Patent Number: 4,620,615

[45] Date of Patent: Nov. 4, 1986

[54] ELEVATOR SYSTEM

[75] Inventors: Arnold M. Morris; Kim E. Morris, both of Chester Township, Morris County, N.J.

[73] Assignee: Westinghouse Electric Corp., Pittsburgh, Pa.

[21] Appl. No.: 798,256

[22] Filed: Nov. 14, 1985

[51] Int. Cl.[4] ..... B66B 11/08

[52] U.S. Cl. ..... 187/22; 254/287; 254/371; 254/396; 226/24; 226/174

[58] Field of Search ..... 187/22, 20, 1 A; 226/183, 174, 24, 25, 34; 254/371, 396, 287

[56] References Cited

U.S. PATENT DOCUMENTS

| | | | |
|---|---|---|---|
| 1,438,674 | 12/1922 | Trumm | 226/183 |
| 3,294,331 | 12/1966 | Wang et al. | 226/24 X |
| 3,794,233 | 2/1974 | Dykmans | 226/183 |

FOREIGN PATENT DOCUMENTS

| | | | |
|---|---|---|---|
| 614477 | 4/1933 | Fed. Rep. of Germany | 187/22 |
| 700414 | 12/1979 | U.S.S.R. | 187/20 |

*Primary Examiner*—Joseph J. Rolla
*Assistant Examiner*—Nils E. Pedersen
*Attorney, Agent, or Firm*—D. R. Lackey

[57] ABSTRACT

Traction enhancement for a traction elevator system has an elevator car and counterweight connected by a plurality of wire ropes reeved about a drive sheave with a predetermined angle of wrap. An arcuate frame having a plurality of rollers has one end pivotally and adjustably fixed, while its other end biases the rollers against the ropes in the angle of wrap with a tension spring. Over travel of the elevator car releases the bias to allow the ropes to slip should the counterweight reach an end of its travel path.

7 Claims, 3 Drawing Figures

ELEVATOR SYSTEM

BACKGROUND OF THE INVENTION

1. Field of the Invention

The invention relates in general to elevator systems, and more specifically to the enhancement of traction in traction type elevator systems to permit the use of a lighter elevator car and counterweight.

2. Description of the Prior Art

Reduction in the dead weight of the elevator car is desirable from a cost viewpoint. In addition to cost savings in the elevator car itself, it enables savings to be made in associated items such as the counterweight, ropes, guide rails, safety, and traction drive machine. A lighter elevator car reduces power requirements from the associated building, as lower peak torques and thus currents are required. A lighter car also results in less mechanical loading on the building.

A limiting factor in reducing the weight of the elevator car and counterweight however, is the tractive force between the ropes and the drive sheave. Sufficient tractive force or traction must be available over the complete range between no-load or empty car, to full load, for the desired acceleration and deceleration rates.

The tractive force between the ropes and sheave is governed by the relationship:

$$T_1 \div T_2 = e^{\mu\theta}$$

where:

$T_1$=rope tension on car side of drive sheave $T_2$=rope tension on counterweight side e=the base of natural logarithms $\mu$=the effective coefficient of friction between the rope and drive sheave for the groove geometry employed $\theta$=angle of wrap or contact between the ropes and drive sheave.

In the prior art, sheave grooves are undercut to increase the effective coefficient of friction $\mu$, but only so much can be done in this regard as the resulting increased pressures on the ropes and sheave grooves shorten both rope and sheave life. Sheave grooves have also been lined with a treaded, elastomeric material in order to increase the effective coefficient of friction $\mu$. Other expedients relate to increasing the angle of wrap by going to a double wrap, and even to a 270° wrap. Increasing the wrap, however, increases the bending forces in the ropes, reducing rope life, and the 270° wrap erodes the sides of the grooves because of the turning and tilting of the drive components in order to prevent interference between the ropes.

SUMMARY OF THE INVENTION

Briefly, the present invention enhances traction, for any given groove geometry and angle of wrap, by adding a constant tension T to both $T_1$ and $T_2$. This allows a reduction in the weight of the elevator car and counterweight. In a preferred embodiment of the invention, the desired result is achieved by employing an arcuate frame having a radius slightly larger than the radius of the drive sheave. The frame carries a plurality of resilient rollers, such as rollers constructed of polyurethane. A first end of the frame is adjustably and pivotally fixed near one end of the angle of rope wrap on the sheave, and the second end is tensioned by a spring. The rollers press the ropes into the sheave grooves. The tension T is adjusted by a jacking bolt and nut at the first end of the frame. The second end of the frame is releasably fixed such that the biased frame is automatically released from the biasing forces should the elevator car over travel in the upward direction. This assures that traction will be broken, at least when the counterweight contacts its buffer, to prevent further upward movement of the elevator car.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
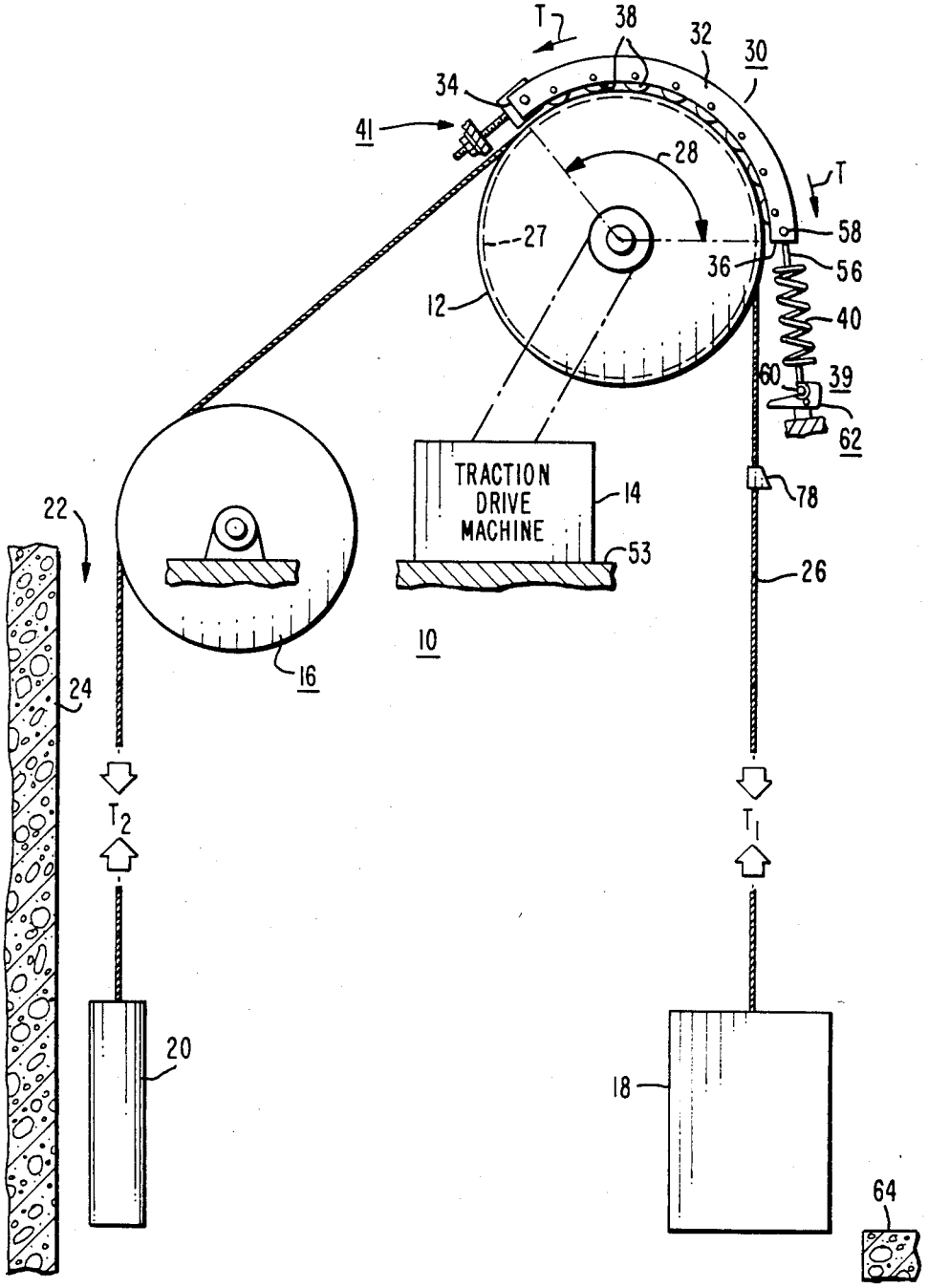
FIG. 1 is an elevational view of a traction elevator system constructed according to the teachings of the invention.

Referring now to the drawings, FIG. 1 is an elevational view of a traction elevator system 10 constructed according to the teachings of the invention. Elevator system 10 includes a traction drive sheave 12 driven by a traction drive machine 14. Single wrap traction roping with a deflector sheave 16 is illustrated in FIG. 1 for purposes of example, but the invention applies to any traction roping arrangement, including single wrap without a deflector sheave, and double wrap.

An elevator car 18 and a counterweight 20 are mounted for guided vertical movement in normal travel paths in the hoistway 22 of a building 24, with the elevator car 18 and counterweight 20 being interconnected via a plurality of wire ropes 26. Wire ropes 26 are reeved about the peripheral grooves of the drive sheave 12, such as groove 27, with an angle of wrap indicated at 28. Only one rope is illustrated in FIG. 1, as the traction enhancement for one rope is repeated for any desired number of ropes.

As shown in FIG. 1, the tension in the ropes 22 is $T_1$ on the car side of the drive sheave 12, and $T_2$ on the counterweight side of the drive sheave 12. A constant tension T is added to both $T_1$ and $T_2$ by traction enhancement means 30. Adding a constant tension T to both $T_1$ and $T_2$ allows the weight of the elevator car 18 and counterweight 20 to be reduced, without reducing the tractive force between the ropes 26 and drive sheave 12.

Traction enhancement means 30 includes an arcuate metallic frame 32 having first and second ends 34 and 36, respectively. Frame 32 includes a plurality of rollers 38 mounted thereon, journaled for rotation, such that the rollers 38 contact the ropes 26 during at least a portion of the angle of wrap 28.

Frame 32 may have a single circumferential row of rollers 38 for contacting a single rope 26. However, in order to minimize rope wear and groove wear, all of the ropes should be pressed into their respective sheave grooves. Thus, in a preferred embodiment of the invention, frame 32 would have a plurality of circumferential rows of rollers 38, i.e., a row for contacting each one of the plurality of ropes 26. The radius of frame 32 is selected such that rollers 38, from roller to roller, will uniformly contact a rope 26 as it proceeds in its travel path about the circular arc defined by a groove in the drive sheave 12.

Tension T is provided by an assembly 39 disposed at the second end 36 of frame 32, with assembly 39 applying a bias to frame 32. The bias is provided by a tension spring 40. Tension adjustment is provided by an assembly 41 at the first end 34 of frame 32. Only a single tension spring 40 is required, but more than one may be used, as desired. The number and size of springs is a function of the economics of spring design and layout restrictions. Only a single tension adjuster is required at the first end 34 of frame 32.

Figure 2:
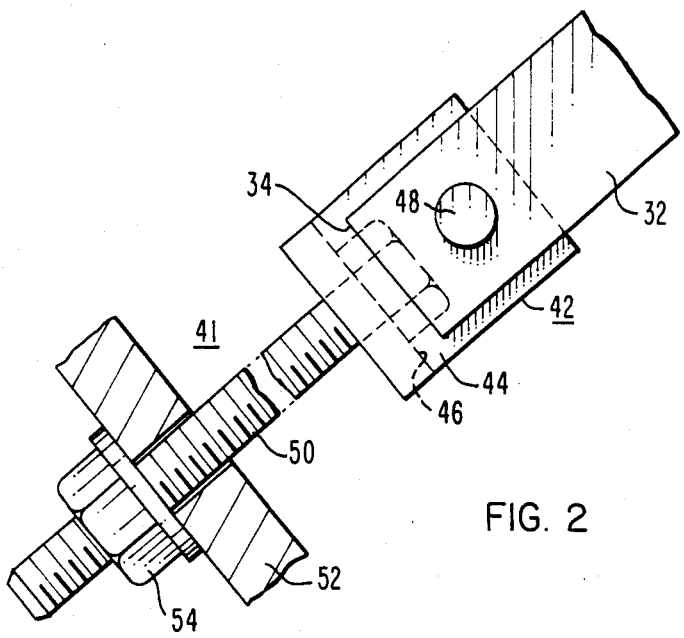
FIG. 2 is an enlarged view of the first end of the roller frame shown in FIG. 1.

More specifically, as shown in FIG. 2, the first end 34 of frame 32 is pivotally fixed at a point adjacent to, but spaced from, one end of the angle of wrap 28. For example, a U-shaped metallic member 42 may be provided having spaced leg portions, such as leg portion 44, and a connecting bight 46. A pivot pin 48 connects leg portions 44 to frame 32. A jacking bolt 50 is disposed through an opening in bight 46, and also through an opening in a stationary member 52. Stationary member 52 may be fixed to the same mounting beam 53 which supports the traction drive machine 14 in the machine room. A jacking nut 54 disposed on the bolt 50 selects the desired tension T. A jamb nut (not shown) may retain the selected position of jacking nut 54.

Tension spring 40 of assembly 39 has an end 56 fixed to the second end 36 of frame 32. For example, end 56 may be looped over a pin 58 fixed to frame 32. The remaining end 60 of spring 40 is connected to a tension release portion 62 of assembly 39. If the elevator car 18 should be driven past the upper floor of building 24, with the uppermost floor being indicated at 64 in FIG. 1, it is desirable that the traction enhancement provided by means 30 be removed. Thus, if the counterweight 20 bottoms on its buffer (not shown) the ropes 26 will be sure to slip in the grooves of the drive machine 12, preventing any further upward travel of the elevator car 18.

Figure 3:
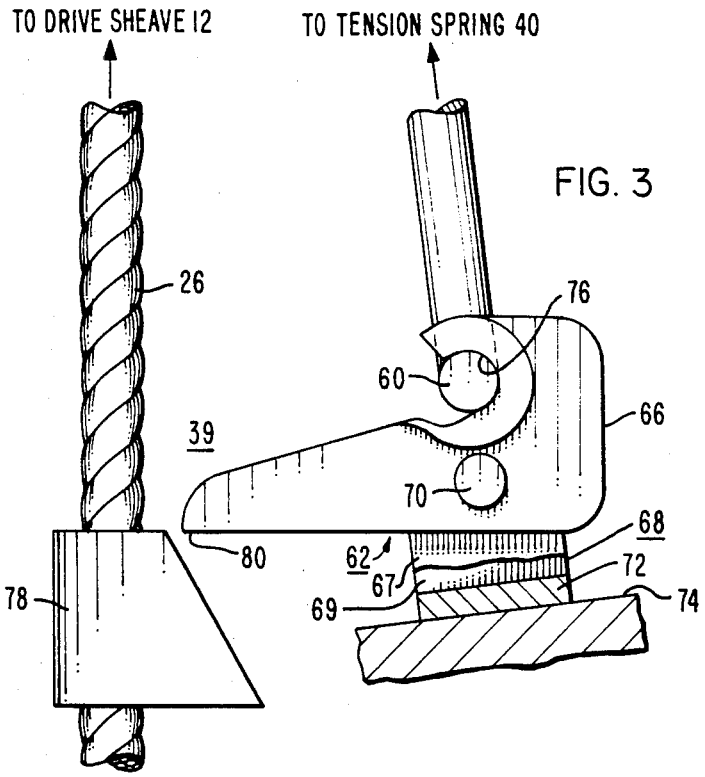
FIG. 3 is an enlarged view of the traction release mechanism disposed at the second end of the roller frame shown in FIG. 1.

As illustrated in FIG. 3, the tension release portion 62 may include a catch 66 which is pivotally secured to the spaced legs 67 and 69 of a U-shaped member 68, via a pivot pin 70. U-shaped member has its bight 72 suitably fixed to a beam 74 in the machine room.

Catch 66 includes a hook portion 76 which engages end 60 of spring 40. A cam 78 is attached at the proper location on a rope 26, such that as the elevator car 18 starts to over travel in the up travel direction, cam 78 will strike an extended arm portion 80 of catch 66, pivoting catch 66 about pivot pin 70 clockwise, as viewed in FIG. 3, to release end 60 from hook 76.

In summary, there has been disclosed a new and improved arrangement for maintaining traction in a traction type elevator system, while reducing the weight of the car and counterweight. The new and improved arrangement requires only a single-point adjustment of the added rope tension T, and it automatically removes the added tension T in the event of car over travel. The disclosed arrangement reduces slip problems, as the added tension T may be increased to the point where slippage is prevented, regardless of car load. Lower peak torques and currents are required due to the reduced weight of the counterweight and car, reducing the traction machine size required, and the mechanical loading on the building is reduced. An added benefit is the fact that since the ropes 26 are positively held in their associated sheave grooves, jumping of the ropes is prevented from the groove should the safety be set. Reduction in weight of the car and counterweight is directly proportional to the magnitude of the spring force applied to the ropes. If the spring force is 600 pounds, for example, the weight of the car and counterweight may each be reduced 300 pounds. In other words the tension T added to $T_1$ and $T_2$ in this example is 300 pounds.

We claim as our invention:

1. An elevator system, comprising:
an elevator car,
a counterweight,
a drive sheave having a peripheral groove,
a wire rope having first and second ends, said wire rope being reeved about said peripheral groove with a predetermined angle of wrap,
said elevator car and counterweight being connected to the first and second ends, respectively, of said wire rope,
drive means for rotating said drive sheave to move said elevator car and counterweight in predetermined normal travel paths,
traction enhancement means,
said traction enhancement means including an arcuate frame having first and second ends,
means fixing the first end of said frame adjacent to said wire rope, near one end of the angle of wrap,
a plurality of rollers on said frame disposed to contact said wire rope in the angle of wrap,
means connected to the second end of said frame for applying a bias to the frame which biases the rollers against said rope,
and means for releasing the bias applied to said frame in response to predetermined travel of said elevator car beyond said normal travel path.

2. The elevator system of claim 1 wherein the means which mounts the first end of the arcuate frame includes adjustment means for adjusting the magnitude of the bias supplied to the frame by the means connected to the second end of the frame.

3. The elevator system of claim 1 wherein the means which mounts the first end of the arcuate frame includes means for pivoting the frame towards the sheave groove.

4. The elevator system of claim 1 wherein the means which mounts the first end of the arcuate frame includes a jacking bolt and jacking nut.

5. The elevator system of claim 1 wherein the means connected to the second end of the frame includes a tension spring.

6. The elevator system of claim 1 wherein the means connected to the second end of the frame is releasably fixed to a catch, and the means which releases the frame bias in response to predetermined travel of the elevator car beyond the normal travel path includes means fixed to the rope which releases the catch.

7. An elevator system, comprising:
an elevator car,
a counterweight,
a drive sheave having a predetermined radius and peripheral grooves,
wire ropes having first and second ends, said wire ropes being reeved about said peripheral grooves with a predetermined angle of wrap,
said elevator car and counterweight being connected to said first and second ends, respectively, of said wire ropes, drive means for rotating said drive sheave to move said elevator car and counterweight in predetermined normal travel paths, traction enhancement means, said traction enhancement means including an arcuate frame whose radius is slightly greater than the predetermined radius of said drive sheave, means pivotally and adjustably fixing the first end of said arcuate frame adjacent to but radially spaced from said wire ropes near one end of their angle of wrap, a plurality of rollers carried by said arcuate frame, said rollers being disposed to contact said wire ropes in their angle of wrap, means connected to the second end of said frame for applying a bias to said frame which tends to pivot the frame towards the peripheral groove, causing said rollers to press the wire ropes into the associated peripheral grooves, and release means on the rope which releases the bias on the frame in the event the release means reaches a predetermined location.

* * * * *